United States Patent [19]

Dondelewski

[11] 4,385,995

[45] May 31, 1983

[54] METHOD OF RECOVERING AND USING FINE COAL

[76] Inventor: Michael A. Dondelewski, 1358 Gertrude Dr., Columbus, Ohio 43227

[21] Appl. No.: 178,620

[22] Filed: Aug. 15, 1980

Related U.S. Application Data

[63] Continuation of Ser. No. 23,744, Mar. 26, 1979, abandoned.

[51] Int. Cl.[3] ..... C02F 1/54

[52] U.S. Cl. ..... 210/705; 210/730; 209/12

[58] Field of Search ..... 209/12; 210/704, 705, 210/708, 730; 44/1.05 R

[56] References Cited

U.S. PATENT DOCUMENTS

| | | | |
|---|---|---|---|
| 3,043,426 | 7/1962 | Noone | 209/12 |
| 3,148,140 | 9/1964 | Kimser et al. | 210/708 |
| 3,579,442 | 5/1971 | Gerwig | 210/704 |
| 3,696,923 | 10/1972 | Miller | 210/704 |
| 4,127,390 | 11/1978 | Dondelewski | 201/17 X |
| 4,199,064 | 4/1980 | Holme | 209/12 |

*Primary Examiner*—Thomas G. Wyse

*Attorney, Agent, or Firm*—Webb, Burden, Robinson & Webb

[57] ABSTRACT

Method of recovering and using heretofore lost or discarded coal fines which are a product of various coal washing processes comprising coating the fine coal with a oil/water mixture, separating excess oil/water mixture, forming into particles as by rolling or tumbling and drying to recover a strong pellet suitable for shipment.

9 Claims, No Drawings

METHOD OF RECOVERING AND USING FINE COAL

This application is a continuation, of application Ser. No. 023,744, filed Mar. 26, 1979 now abandoned.

BACKGROUND OF THE INVENTION

Large quantities of coal are lost or discarded as useless fines. These fines are generated in various crushing and washing processes. They may also be generated by hydrodesulfurization processes that involve a crushing step prior to chemical treatment. One such process is described in my U.S. Pat. No. 4,127,390 and in my co-pending U.S. application Ser. No. 953,011, filed Oct. 25, 1978 now U.S. Pat. No. 4,183,730.

Hydrodesulfurization processes which relay upon selective reaction with the sulfur ingredients tend to require pulverized coal as a starting ingredient. These processes naturally generate a larger amount of fines than simple washing processes.

Coal fines cannot be transported by conventional means and often allowed to gather unused in large settling basins. These fines are not easily separated from water and even if separated, they cannot be transported in open trucks or cars due to the small particle size. Notwithstanding this drawback, coal fines are a useful energy source and where the fines comprise low sulfur metallurgical quality coal, they are especially desirable for production of coke or for burning in environmentally sensitive locations.

Various prior art methods of treating coal fines to make them suitable for shipment include coating with tar, molasses and similar materials. To applicant's knowledge, they have not produced a strong enough pellet for shipping and handling with normal coal handling equipment. Water soluble binders are unsuitable as the coal pellets made from fines must be able to withstand weathering at outdoor storage locations.

The invention described herein not only allows recovery of hereto wasted coal fines discarded from traditional coal washing process but allows the economical implementations of certain hydrodesulfurization processes which generate large quantities of coal fines.

SUMMARY OF THE INVENTION

Coal fines are generally slurried and screened to remove large chunks and particles. Preferably, the particles larger than 28 mesh Tyler Sieve Series are removed from the slurry. Generally speaking, a coal fines particle size of 60 to 200 mesh Tyler Sieve Series is preferable as a starting material for this process. The coal fines slurry is fed to a conditioning tank where light oil, for example vegetable oil, is mixed with the slurry. Preferably the amount of oil mixed with the water is between 10 and 25 percent by weight of the coal fines. The concentration of the coal in the liquid (oil and water) is between about 10 to 25 percent by volume. The coal slurry is introduced into a flotation cell or the like that intensely agitates the slurry. Air may be added and a froth containing the coal fines and adsorbed oil will be formed over the water. The coal froth, commonly called float, is then directed as by skimming to a filtering or liquid separating device where excess oil/water mixture is separated. The means for removing excess liquid from the froth includes vacuum filters, vibratory screens, centrifuges etc. Some liquid not adsorbed on the surface of the coal fines may be retained in order to facilitate the subsequent agglomeration or pelletizing step. Separated oil/water mixture may be returned to the conditioning tank for reuse.

A moist cake of coal fines is then introduced into a mechanical pelletizer where pellets of coal are formed. The pelletizer may simply comprise a rotating dish or drum in which the cake breaks up and rolls into balls. A blast of hot air may be directed at the rolling pellets in the pelletizer to cause a certain amount of predrying. In another embodiment, the cake may be pressed into briquettes on briquetting rolls. In yet another embodiment, the filter cake may simply be broken up into pieces on a conveyor belt.

The pelletized coal is then introduced into a drier where water is removed to provide a dry pellet. The temperature of the drier must not cause the coal fines or adsorbed oil to ignite. a temperature of 150° to 500° F. is adequate. A slight vacuum may be desirable to increase the drying rate. Upon drying a strong weather resistent coal pellet is recovered.

If the sulfur ash content of the pulverized coal is not acceptable, the coal, prior to separation of fines or thereafter, may be desulfurized using the novel process disclosed in my above referenced U.S. Patents. In this case, care should be taken to keep the pH of the slurry in the conditioning tank near neutral, i.e., between 6.5 and 9.

DESCRIPTION OF THE PREFERRED EMBODIMENTS

Example I

Coal previously pulverized to a particle size of minus 200 mesh (Tyler Series) was treated using the hydrodesulfurization process of my co-pending patent application. The coal initially analyzed 14.46 percent by weight ash and 3.47 percent by weight sulfur. After desulfurization the coal analyzed 7.04 percent ash and 1.02 percent sulfur.

A washed coal sample of 120 grams was then slurried with 2 liters of water mixed with 22.5 grams vegetable oil. The coal slurry was then introduced into a laboratory model froth flotation cell operated at an impeller speed of about 900 rpm. After about three minutes, coal froth began forming and was skimmed from the surface of the cell. Excess liquid was removed from the froth by suction filtering. The relatively dried filter cake was broken into chunks and dried in an oven at 200° F. (for about 1.5 hours). The small pieces of filter cake were strong after drying.

To test the ability to resist weathering, the dried pellets were soaked for 48 hours in clean water. No visible separation of the fine coal particles took place. Upon removal of the resoaked pellets from the water, they were tested by tossing against hard surfaces, e.g., concrete. No disintegration took place. Clearly, such strong pellets will be handleable by normal coal handling techniques.

Example II

A sample of coal containing a large amount of ash and sulfur was ground to pass 60 mesh. The sample was purposely not chemically desulfurized. The flotation cell itself produces some separation of ash and sulfur from the coal fines.

About 380 grams of ground coal was slurried with 2 liters of water mixed with 80 grams of vegetable oil. The mixture was introduced into a laboratory model flotation cell. Upon agitation, a coal containing froth was formed. The coal froth was skimmed and the froth filtered with a laboratory vacuum filter. The filter cake was then balled in a pan to which a circular motion was applied. Ball shaped well sticking pellets were formed. The pellets had good integrity prior to drying. When dropped to the floor from a height of about 3 feet, the pellets deformed plastically but did not disintegrate. Upon drying at 220° F. for 3 hours, the pellets became very hard and resistant to disintegration. In this embodiment, the liquid separated from the coal still contained a large amount of oil.

Applicant does not claim to thoroughly understand the reasons why very hard weather resistant pellets are formed by the above identified process. The oil used is very light weight, preferably vegetable oil, and is used in relatively small amounts. It would appear that an oil/water layer is built around and between the fine coal particles prior to drying and upon drying the water is removed. Perhaps some reaction takes place upon drying between the oil and coal. In any event, the rewetting of the dried pellets does not reverse the hardening process that takes place upon drying.

This invention is applicable to fossil fuel or coal werein the meaning of the terms includes, for example, anthracite, bituminous coal and so forth. By "light oil" as used herein, reference is to relatively nonviscous oils that easily mix with water and coat the coal fines upon agitation in the floatation cell. I have found that mineral oils and lubricants which are essentially hydrocarbons derived from petroleum and its products will work to pelletize coal fines but that upon drying hard pellets are not formed. Vegetable oil, for example soy bean oil, works to form pellets and upon drying the pellets are hard. The light oils contemplated by this invention are also known as fixed oils. Fixed oils are derived from the fatty substances of vegetable and animal organisms and contain esters (usually glycerol esters) of fatty acids.

Having thus defined my invention in the detail and with the particularity as required by the Patent Laws, what is desired protected by Letters Patent is set forth in the following claims.

I claim:

1. The method of recovering coal fines comprising the steps for:

a. slurrying the fines in a mixture of water and fixed oil in excess of the amount of fixed oil the fines will gather on their surfaces,
b. agitating the mixture to form a froth containing the fines,
c. skimming the froth containing coal fines from the liquid over which it floats,
d. separating excess water and fixed oil from the froth to form a filter cake,
e. pelletizing said filter cake, and
f. heating and drying said pellets.

2. The method according to claim 1 wherein the the fixed oil mixed with the water in which the coal fines are slurried comprises 10 to 25 percent by weight of the coal fines.

3. The method according to claims 1 or 2 wherein the concentration of coal fines in the slurry is between 10 and 25 percent by volume.

4. The method according to claim 2 wherein the liquid separated from the froth is returned to slurry more coal.

5. The method according to claims 1 or 2 wherein the pellets are dried at a temperature between 100° and 500° F.

6. The method according to claim 1 wherein the coal fines are first screened to remove coarser particles before slurrying the fines.

7. In a method of hydrodesulfurization of coal, the steps for recovering the fine coal comprising the steps for:

a. slurrying the fines in a mixture of water and fixed oil in excess of the amount of fixed oil the fines will gather on their surfaces,
b. agitating the mixture to form a froth containing the fines,
c. skimming the froth containing coal fines from the liquid over which it floats,
d. separating excess water and fixed oil from the froth to form a filter cake,
e. pelletizing said filter cake, and
f. heating and drying said pellets.

8. The method according to claim 7 wherein the pH of the mixture of water and fixed oil is maintained near neutral.

9. The methods according to claims 1 and 8 wherein the fixed oil is vegetable oil.

* * * * *